US007036430B2

(12) United States Patent
Figov et al.

(10) Patent No.: US 7,036,430 B2
(45) Date of Patent: May 2, 2006

(54) METHOD FOR PRODUCING A FLEXOGRAPHIC PRINTING PLATE FORMED BY INKJETTED FLUID

(75) Inventors: Murray Figov, Raanana (IL); Shraga Dvoretzki, Kfar Saba (IL)

(73) Assignee: CREO IL Ltd., Herzlia Pituach (IL)

( * ) Notice: Subject to any disclaimer, the term of this patent is extended or adjusted under 35 U.S.C. 154(b) by 141 days.

(21) Appl. No.: 10/730,490

(22) Filed: Dec. 9, 2003

(65) Prior Publication Data

US 2004/0129158 A1 Jul. 8, 2004

Related U.S. Application Data

(60) Provisional application No. 60/436,009, filed on Dec. 26, 2002.

(51) Int. Cl.
*G03C 7/00* (2006.01)

(52) U.S. Cl. ..... 101/463.1; 101/453; 101/401.1; 101/395

(58) Field of Classification Search ..... 101/401.1, 101/453, 395, 454, 463.1; 430/300, 301, 430/302, 303, 306, 310
See application file for complete search history.

(56) References Cited

U.S. PATENT DOCUMENTS 5,511,477 A 4/1996 Adler et al.
5,654,125 A 8/1997 Fan et al.
5,779,779 A 7/1998 Jolly
6,358,668 B1 3/2002 Leenders et al.
6,387,594 B1 * 5/2002 Kakishita et al. ..... 430/300
6,520,084 B1 * 2/2003 Gelbart ..... 101/401.1
6,637,335 B1 * 10/2003 Jentzsch ..... 101/463.1
6,699,640 B1 * 3/2004 Verschueren et al. ..... 430/302
6,895,860 B1 * 5/2005 Mori ..... 101/460
2002/0029708 A1 * 3/2002 Loccufier et al. ..... 101/453
2002/0058196 A1 * 5/2002 Kanga ..... 430/270.1
2003/0087178 A1 * 5/2003 Lungu ..... 430/162
2003/0180655 A1 * 9/2003 Fan et al. ..... 430/270.1
2003/0211423 A1 * 11/2003 Mengel et al. ..... 430/306

FOREIGN PATENT DOCUMENTS

GB 1431462 4/1976

OTHER PUBLICATIONS

"The Printing Ink Manual", edited By R.H. Leach and R.J. Pierce —5th edition, published in 1993 by Blueprint Press, pp. 33-42.

* cited by examiner

*Primary Examiner*—Daniel J. Colilla
*Assistant Examiner*—Kevin D. Williams
(74) *Attorney, Agent, or Firm*—Edward Langer, Pat. Atty; Shiboleth, Yisraeli, Roberts, Zisman & Co.

(57) ABSTRACT

Apparatus and method for digitally building up flexographic plates by ink jetting plate pre-cursor material onto a substrate via an offset blanket and forming the plates by successively polymerizing the ink jet fluid.

32 Claims, 4 Drawing Sheets

METHOD FOR PRODUCING A FLEXOGRAPHIC PRINTING PLATE FORMED BY INKJETTED FLUID

This application claims priority to U.S. Provisional Application No. 60/436,009, filed on Dec. 26, 2002.

FIELD OF INVENTION

The invention relates to a method of digitally constructing a flexographic printing plate by point-to-point deposition of a UV curable mixture to build up successive layers of the image-bearing print areas.

BACKGROUND OF THE INVENTION

Flexography is a method of direct rotary printing that uses resilient relief plates of rubber or photopolymer material. The plates may be flat or in the form of sleeves and in both cases they are used in the printing process by securing them to a cylinder where they are inked by a cell-structured Anilox metering roller. Flexographic presses can be used to print on a large range of substrates and are particularly used in the packaging industry, for printing on board, paper, foil and film.

Compared to other printing processes such as offset lithography or gravure, the relief image on the flexographic plate is very thick—mostly of the order of millimeters high. A popular method of producing such plates is by using thick photopolymerizable layers and imaging by hardening through a photo-tool. The unhardened photopolymer precursor may then be washed away with solvent. This process requires the pre-imaging of the photo-tool which is usually in the form of a silver halide based film and then multiple steps to prepare the flexo plate by UV exposure, washing, drying, etc. A description of the flexographic process including plate-making may be found in "The Printing Ink Manual", edited by R. H. Leach and R. J. Pierce—$5^{th}$ edition, published in 1993 by Blueprint Press (pages 33 to 42).

Process simplification and acceleration of plate-making are desirable targets for flexography in the same way as they have been for offset lithography. Thus, the computer-to-plate concept which has become popular for offset has also been exploited for flexography. For instance, U.S. Pat. No. 5,654,125 describes the formation of an integral photo-tool in a process and apparatus for image-wise ablating an infrared radiation sensitive layer of a flexographic element, for use in making a flexographic printing plate. The photopolymer flexo plate has a top coating, which may contain a high concentration of carbon black. The layer absorbs infrared radiation and when imaged using an infrared emitting laser as an imaging source, areas become hot from infra red absorption and are ablated away in what will be the image areas. The layer in which selected areas have been ablated becomes the integral photo-tool and UV exposure is made through these ablated gaps in the coating. Where the carbon layer is unablated it prevents the photopolymerization of the UV sensitive layer. Where the carbon has been ablated away the UV light causes polymerization of the photopolymer. The plate is then washed to remove the carbon layer and the unpolymerized photopolymer precursor. Thus, such plates can be considered as digital and are analogous to the computer-to-plate technology developed for offset lithographic printing. The process eliminates the need for the silver halide photo-tool, which involves dark room facilities as well as the use of unstable environmentally undesirable processing liquids. The plates give enhanced quality over conventional plates, but require relatively high energies (up to 5 joules per square cm.) to ablate the carbon layer. This is because the layer needs to be thick enough to give a high optical density to block the UV exposure needed to polymerize the relatively thick pre-polymer layer. Such plates are relatively expensive and still involve a multiplicity of stages in their preparation.

Alternative methods of using digital imaging in the production of relief printing plates are based on inkjet. The use of ink jet as a means for producing relief images is suggested in UK Pat. No. 1431462. Here, the inkjet fluid alters the solubility properties of the coating on a substrate. The image produced is only a few microns thick and can be used for offset lithography. However, the imaged plate is not of a flexographic nature, since the surface does not have suitably elastomeric properties.

An alternative method of digital plate formation is to ink jet the mask onto the plate and a number of inventions have been published using this idea. Here, the background must be covered with the masking ink and the unimaged areas from the inkjet part of the process are then used as the final relief areas of the printing plate.

U.S. Pat. No. 5,779,779 uses a Hot Melt inkjet ink for UV blocking on the flexo plate. U.S. Pat. No. 6,358,668 uses a water-based inkjet ink and a special ink-receiving layer coated onto the flexo plate to ensure good UV blocking properties for the ink. The use of ink jet inks as masks still requires subsequent wet stages of washing out uncured material and then drying the plate.

U.S. Pat. No. 5,511,477 describes the formation of various types of printing plates including flexographic printing plates using a UV curable ink jet ink, by directly jetting onto a substrate base. However, the actual height of the image is only that of one layer of the inkjet drops and thus it would be difficult to produce flexographic plates of acceptable performance, because flexography is designed for plate image thickness in the order of magnitude of millimeters. Ink jet produces images in the order of magnitude of microns.

SUMMARY OF INVENTION

It is an objective of the invention to provide a method for digitally building up flexographic plates by ink jetting plate pre-cursor material onto a substrate via an offset blanket and forming the plates by successively polymerizing the ink jet fluid.

There is thus provided a method of digitally building up flexographic plates, comprising the steps of: a. providing a plate substrate and an imaging surface; b. depositing an elastomeric matrix floor onto said plate substrate; c. curing said deposited matrix floor; d. inkjet imaging one layer on said imaging surface according to pre-stored digital image data; e. UV exposing said imaged layer to create a gelled layer; f. transferring said gelled layer from the imaging surface to the surface of the matrix floor on said plate substrate; g. bonding said gelled layer with the matrix floor; and h. repeating steps (d) through (g) until an image of sufficient thickness is created on said plate substrate.

In one embodiment, the plate substrate may form a sleeve around a plate cylinder of a flexographic printing press.

In another embodiment, the plate substrate may comprise a plate cylinder of a flexographic printing press.

The plate substrate may comprise a metal plate or polyester.

The matrix floor may comprise UV curable material.

The matrix floor may comprise a solvent and the method may additionally comprise the step of heating said matrix floor to evaporate said solvent.

Steps (b) and (c) may be repeated until a matrix floor of required thickness is formed.

The step of curing may comprise using a UV source external to said plate cylinder.

The last deposited matrix floor layer may be thin and only partially cured.

The imaging surface may comprise one of a cylinder, a blanket and a belt.

The step of UV exposing may comprise using a UV source external to said imaging surface.

The method may additionally comprise, after said step of bonding, the step of enlarging the distance between said plate cylinder and said imaging surface to accommodate additional layers.

The image on the plate cylinder may be built in the form of pyramids.

The top surface of said image on the plate cylinder may comprise an extra tough material.

The step of depositing and the step of inkjet imaging may comprise using liquids based on one of urethane acrylate and methacrylate oligomers.

It is an other objective to provide an apparatus which will enable such plates to be formed automatically in an inexpensive and rapid manner.

There is thus provided an apparatus for digitally building up flexographic plates, comprising: a plate substrate for receiving a matrix floor; curing means for curing said matrix floor; an imaging surface adjacent said plate substrate; inkjet imaging means adjacent said imaging surface for ink-jetting an image onto said imaging surface according to pre-stored data; UV exposing means for gelling said image; and bonding means for bonding said gelled image with said matrix floor.

In one embodiment the plate substrate may form a sleeve around a plate cylinder of a flexographic printing press.

In another rembodiment the plate substrate may comprise a plate cylinder of a flexographic printing press.

The plate substrate comprises a metal plate or polyester.

The matrix floor may comprise UV curable material.

The matrix floor may comprise a solvent.

The apparatus may additionally comprise heating means for evaporating said solvent from said matrix floor.

The curing means may be external to said plate cylinder.

The imaging surface may comprise one of a cylinder, a blanket and a belt.

The UV exposing means may be external to said imaging surface.

The apparatus may additionally comprise means for enlarging the distance between said plate substrate and said imaging surface.

The matrix floor material and the inkjet ink may comprise liquids based on one of urethane acrylate and methacrylate oligomers.

In another aspect of the present invention there is provided a method of printing using a flexographic printing press, comprising the steps of:

a. providing a plate substrate and an imaging surface; b. depositing an elastomeric matrix floor onto said plate substrate; c. curing said deposited matrix floor; d. inkjet imaging one layer on said imaging surface according to pre-stored digital image data; e. UV exposing said imaged layer to create a gelled layer; f. transferring said gelled layer from the imaging surface to the surface of the matrix floor on said plate substrate; g. bonding said gelled layer with the matrix floor; h. repeating steps (d) through (g) until an image of sufficient thickness is created on said plate substrate; and i. using said imaged plate for printing on said flexographic printing press.

In one embodiment, the step of using comprises transferring said imaged plate to said flexographic printing press.

DETAILED DESCRIPTION OF INVENTION

The method of the present invention uses the drop-on-demand inkjet process for the purpose of creating flexographic printing plates. Ink jet heads for use in this process are readily available and can be manufactured especially for ultra-violet curable fluids in that the component parts and glues bonding them together are resistant to such materials. In addition, there are components in the UV fluid systems (known as oligomers) that tend to be of higher viscosity than that suitable for ink jet printing. Oligomers in this context are relatively large acrylate molecules that can be photopolymerized to give strong solvent insoluble polymers, which may be used as suitable bases for ink jet inks. Ink jet viscosities are at the maximum around 30 centipoises and are often under 10 centipoises. It is difficult to produce UV inks of such low viscosity, because of the high viscosity of the oligomer that such inks must contain. Thus, it has become common practice to heat the UV fluid in the inkjet in order that it should have a suitable viscosity for ink jetting. Alternatively, some solvent may be added to reduce viscosity, in which case it may be evaporated off before curing.

In the application of creating flexographic printing plates, a further constraint on the ink formulation is that the cured polymer must have elastomeric properties that characterize flexographic plates. Suitable formulations may be devised as instanced below, or may be chosen from liquid polymer mixtures sold for flexo plate preparation. Suitable types of formulation are based on systems that result in plates by cross-linking poly (2-chloro-1,3-butadiene) commonly known as chloroprene, cross-linked with trimethylolpropane triacrylate using a photoinitiator. MacDermid, of Atlanta, Ga. manufactures a large range of liquid photopolymer resins. These are known as Flex-lights and can be used as the basis for inks for the present invention. They too can be diluted with solvent to give appropriate viscosities.

Figure 1:
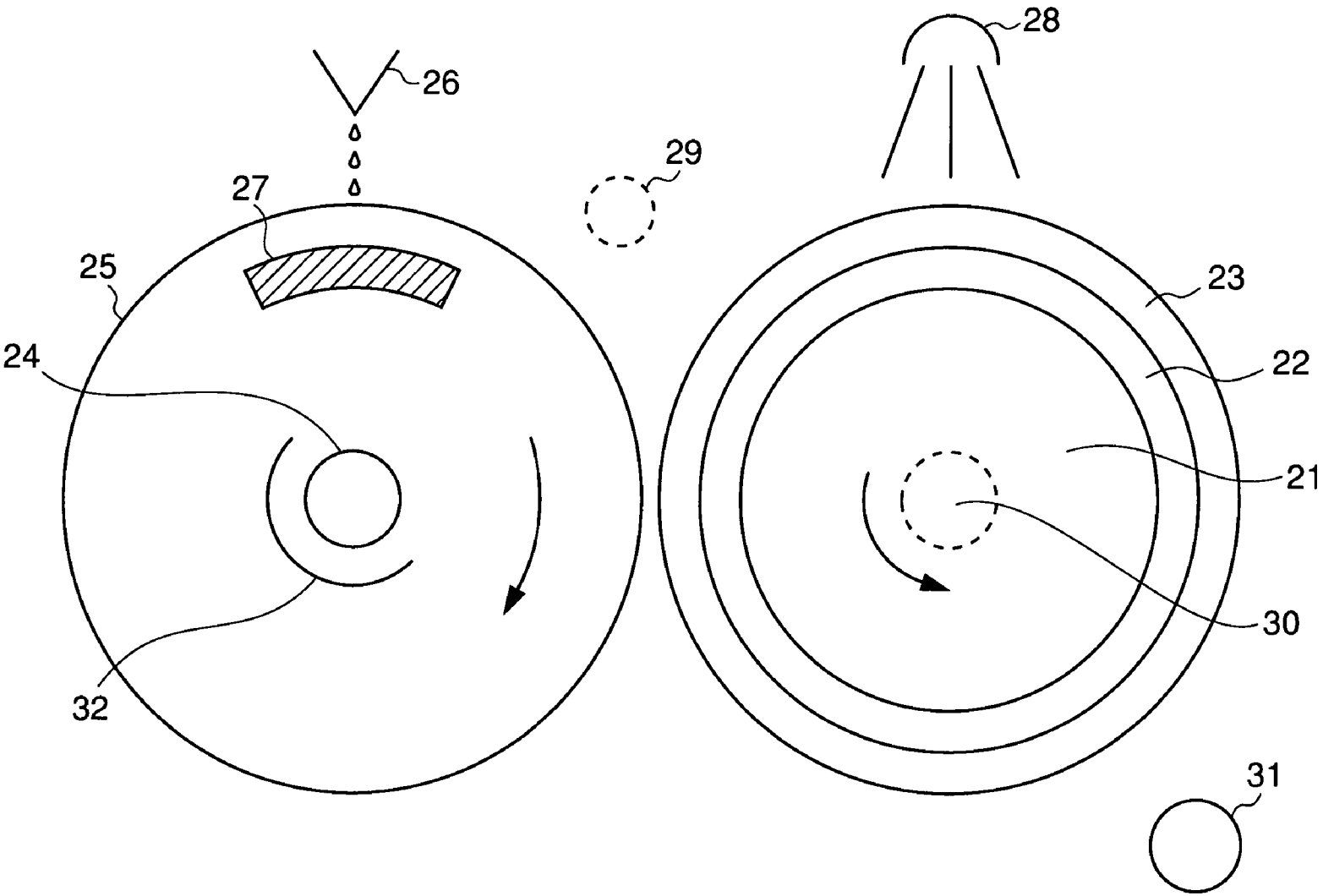
FIG. 1 is a schematic design of an apparatus for use with the present invention.
Figure 2:
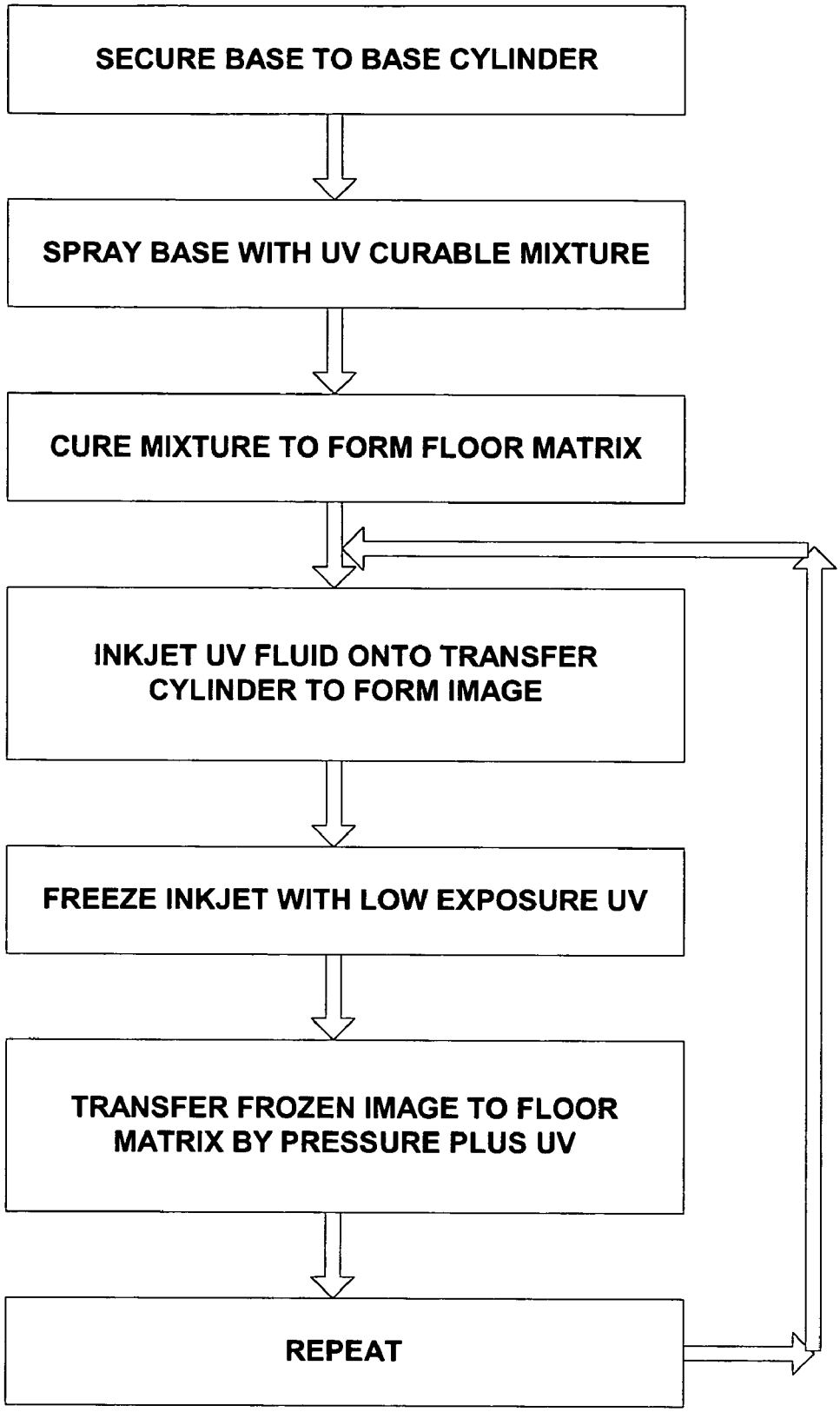
FIG. 2 is a flow diagram for plate preparation according to the present invention.

A first embodiment is described referring to FIG. 1, which is a schematic design of an apparatus for use with the present invention. In FIG. 1, the cylinder 21 has a sleeve 22 of substrate attached to its outer surface. Such a sleeve may be of polyester or any other suitable substrate material. It may be in the form of an endless band or may be a flat piece of film that can be bonded onto the cylinder with, for instance, double-sided tape, as described in U.S. Pat. No. 6,450,092 to the same assignee. Suitable tapes are available commercially and have been designed for such applications for mounting flexo plates on the printing cylinder. A spray 28 may be used to deposit an elastomeric layer known as the matrix floor (23) onto the polyester base. Such a layer may be deposited on the substrate by any coating means (but here shown as a spray 28) and should be formed from suitable UV curable material with or without a solvent such as alcohol used as a means of reducing viscosity. The coating layer may be heated to evaporate solvent if one is used and then cured during deposition so that a succession of layers can be easily built up and cured to any required thickness.

The UV source may be located external to the cylinder 21—for example in an adjacent UV transparent cylinder 25—or internal to cylinder 21, so long as cylinder 21 is itself UV transparent. Preferably, the source is external so that each fresh layer of material is exposed without the radiation having to pass through previously exposed layers. This process produces a resilient cushion of material which contributes to the flexibility of the plate and is known in the art as the floor matrix. Also, the resulting surface, whether the substrate was originally in the form of a seamless sleeve or a seamed band, will be seamless once the coating has been applied, as it will cover and fill up any gap where plate ends meet. A seamless plate surface has a significant advantage in that the pattern of the image may continue around the entire cylinder and provides a printing member that prints with much less waste in the printing substrate.

The UV source is shown in the diagram as locations 24, 30 or 31. It may be, for instance, a mercury vapor lamp located inside a cylinder of cooled quartz glass (25). The cylinder 25 is the one on which imaging will occur and provides external curing of the floor matrix. For internal curing, the lamp 30 is located inside the plate cylinder 21. As explained above, according to whether the source 24 or 30 is used for this stage, the coating layers will be cured from the top surfaces or from the bottom surfaces. The final layer of the matrix floor can be a thin layer and may be only partially cured to give the image better adhesion when the first layer of the image is deposited.

After the matrix floor has been formed, the elastomeric precursor inkjet ink is jetted out of the ink jet nozzle or nozzles 26 to form a first layer of image on the cylinder 25. 25 may be a cylinder, a blanket or a belt. It may be a cooled quartz glass inside which is a UV lamp 24 situated inside a reflector 32. The glass may be coated with a release layer. Instead of glass, a Teflon or silicone coated endless band mounted on rollers can be used to contain the UV source. The advantage of a band design is that the area where the ink jet(s) operate can be flat rather than curved. The inkjets 26 may be a single heated DOD head or may be a plate-width array of jets. There can be more than one head or array of inkjets that may deliver different mixtures of fluids. The fluid or fluids may be fed into the heads as pre-formed mixtures or mixed together on the way to the head or heads. The jetted image of fluid is in the pattern of the printing plate image.

The part of the cylinder 25 opposite the inkjet head or heads is shielded off by element 27, such as a UV opaque metal or plastic sheet, so that no UV light can directly impact the head, thus avoiding curing of the ink during the jetting process. After a complete image has been deposited on the cylinder blanket roller or belt it is subject to a low power UV exposure either from within the belt or externally (source 29). If the source is external, it may be the same source as 31, previously described for use in the UV curing of the base layer 23. The position of the UV source 29/31 would then be between the cylinders 25 and 21. The exposure is sufficient to gel the layer formed.

Figure 3B:
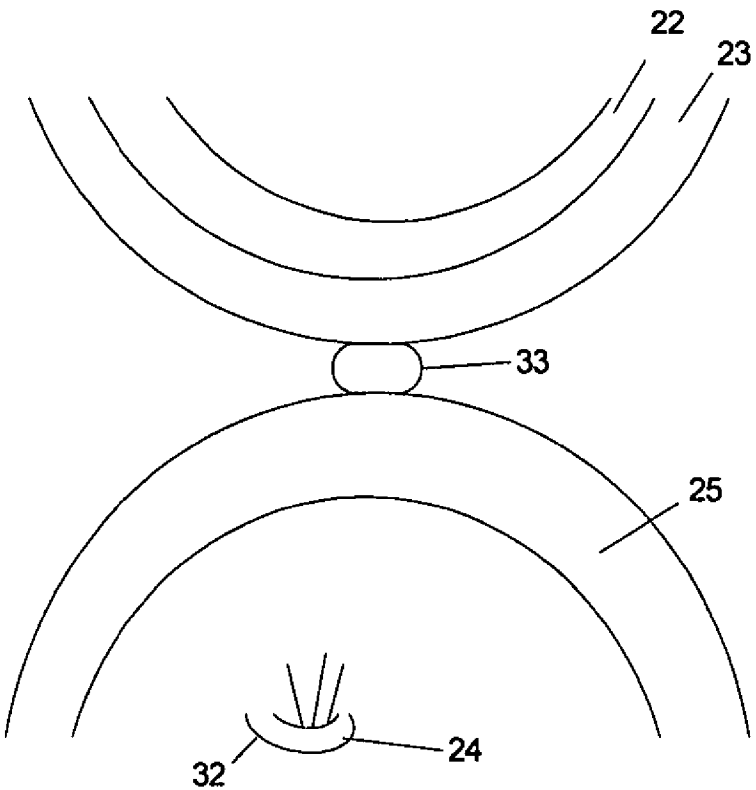
FIGS. 3A–3C show the stages of droplet gelling and transfer in the successive build-up of a plate image according to the present invention.
Figure 3A:
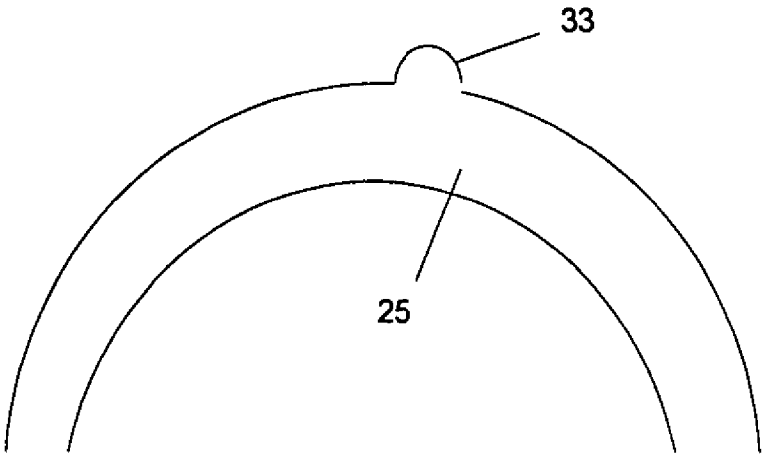
Figure 3C:
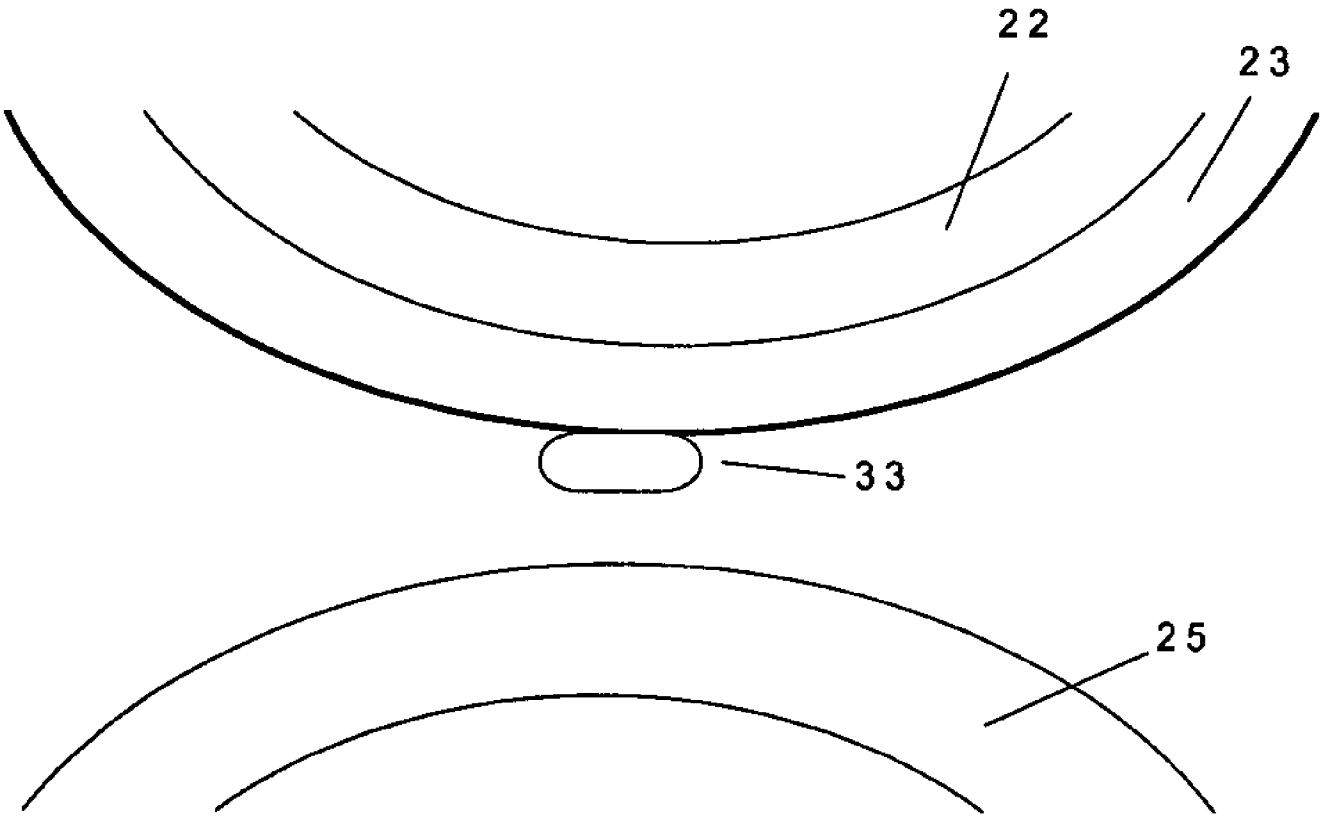

The gelled image (33 in FIG. 3A) is then brought into contact with the matrix floor layer 23 and subjected to a further UV exposure from either the source 24 or source 30. This exposure completely cures the formed image and during curing it becomes bonded to floor matrix 23 (FIG. 3B). During the first exposure of the image, the surface of the ink jet drops remains the least cured, because it is exposed to air and consequently suffers from oxygen inhibition. Peroxides are formed between the inkjet mixture and the oxygen of the air and this occupies the activity of free radicals, which would otherwise be curing the mixture. Also, the ink jet is deposited in a non-impact mode and remains on the non-absorbent surface of 25 as a hemispherical-like shape. Such a shape would not be suitable for building up further layers as will be described. During the image transfer, the curved top of the gelled image droplets are gently pressed against the matrix floor layer, excluding air and permitting the final curing and bonding to the base layer. The upper surface of the matrix floor now contains a layer of ink drop image with a flat surface which was originally the bottom surface of the ink jet drop as it landed on the substrate 25. This is shown in FIG. 3C. Cylinder 21 is spring-loaded or fitted with a screw device, which moves it along the axis connecting the centers of cylinders 21 and 25, to widen the point of contact between the cylinders as the thickness builds.

It is now possible to deposit a further ink jet layer onto substrate 25 and transfer it as described above so that it builds up an image of significant thickness on layer 23. The physical shape of the image in the height direction can be varied according to the computer generated image of each layer. Thus, the image can be in the form of a pyramid. It can also be varied in elastomeric or other properties so that for instance the top final uppermost surface of the layer can be designed to give hard wear during the printing process. This is known in the art as capping.

In describing this invention, a distinction can be drawn between what part of the process is done by the manufacturer and vendor of the process and what is done by the person who images and prints the flexographic plate (referred to herein as the user). Thus, the machine vendor would be expected to supply the fully operational equipment, the polyester substrate and the UV curing mixtures. The user would be expected to mount the floor substrate, coat it to form the floor matrix and image it with the successive layers of material. Thus, there is a distinction in roles between what a user is expected to do here and in previous processes of plate production, where the user is supplied with a ready-formed plate, which then needs imaging and processing. An advantage of the invention is that by forming the plate in situ, there is no need to have plate shelf life stability, nor to have handleability (so the plate can be sticky or liquid in its unprocessed form).

The imaging cycle must be rapid, because each layer may be as little in height as 5 microns and 100 rotations may be necessary to form the full height of the image. By having various heads it is possible to deposit material of variable composition so that the final top surface, for instance, may be able to be an extra tough material that can withstand the wear of the printing process.

This apparatus can be organized to work on the flexo press itself, or the final plate, whether in the form of a sleeve or in the form of a planar plate, may be transferred from the imaging device to a conventional flexo press. Another alternative is to use a metal substrate for the plate. All exposure may be done external to such a plate. After printing, the coatings may be scraped off of the plate and the entire process repeated without recourse to a new substrate.

Suitable liquids for use both as the floor matrix and for the ink jet mix may be based on urethane acrylate or methacrylate oligomers blended together with suitable monmers, photoinitiators and other additives such as polymers. Such formulations are well-known in the art and are used in liquid photopolymer platemaking. Whereas most recent inventions in this field attempt to make such pre-polymeric mixtures water soluble (see for instance U.S. Pat. No. 6,423,472B1), because after image/curing the uncured material has to be removed, there is no such restraint in the invention described herein, because no washing stage is involved. However, suitable formulations may be chosen that give good ink-jetting properties when used at elevated temperatures.

An example to illustrate some of the features of the invention is given below. The following mixture was made up (parts by weight):

| | |
|---|---|
| Ebecryl 230* (undiluted high molecular weight aliphatic urethane diacrylate) | 45 parts |
| IBOA (isobornyl acrylate) | 51 parts |
| Rose Bengal | 0.7 parts |
| 1-hydroxy-cyclohexyl-phenyl ketone | 2.5 parts |

*Ebecryl 230 from UCB Chemicals Corporation, 2000 Lake Park Drive, Smyrna, Georgia, USA.

The mixture was coated onto polyester with a bar that laid down a coating 50 microns thick. The mix was cured with a mercury vapor lamp and a further layer coated on top until a thickness of 500 microns was achieved. This produced a simulated floor matrix. The same mixture was placed in a syringe and fine drops deposited on a siliconized film in marked areas. The drops were gelled by a short exposure to UV and the floor matrix placed faced down on top of the gelled drops. The sandwich was passed through UV with the polyester of the floor matrix uppermost. The sandwich was then peeled apart and the dots of material were found to be bonded to the floor matrix. The procedure was repeated to build up three-dimensional spots.

The invention claimed is:

1. A method of digitally building up flexographic plates, comprising the steps of:

a. providing a plate substrate and an imaging surface;

b. depositing an elastomeric matrix floor onto said plate substrate;

c. curing said deposited matrix floor;

d. inkjet imaging one layer on said imaging surface according to pre-stored digital image data;

e. UV exposing said imaged layer to create a gelled layer;

f. transferring said gelled layer from the imaging surface to the surface of the matrix floor on said plate substrate;

g. bonding said gelled layer with the matrix floor; and h. optionally repeating steps (d) through (g) until an image of sufficient thickness is created on said plate substrate.

2. The method of claim 1, wherein said plate substrate forms a sleeve around a plate cylinder of a flexographic printing press.

3. The method of claim 1, wherein said plate substrate comprises a plate cylinder of a flexographic printing press.

4. The method of claim 1, wherein said plate substrate comprises a metal plate.

5. The method of claim 1, wherein said plate substrate comprises polyester.

6. The method of claim 1, wherein said matrix floor comprises UV curable material.

7. The method of claim 1, wherein said matrix floor comprises a solvent.

8. The method of claim 7, additionally comprising the step of heating said matrix floor to evaporate said solvent.

9. The method of claim 1, wherein steps (b) and (c) are repeated until a matrix floor of required thickness is formed.

10. The method of claim 1, wherein said step of curing comprises using a VV source external to said plate cylinder.

11. The method of claim 8, wherein the last deposited matrix floor layer is thin and only partially cured.

12. The method of claim 1, wherein said imaging surface comprises one of a cylinder, a blanket and a belt.

13. The method of claim 1, wherein said step of UV exposing comprises using a UV source external to said imaging surface.

14. The method of claim 1, additionally comprising, after said step of bonding, the step of enlarging the distance between said plate cylinder and said imaging surface to accommodate additional layers.

15. The method of claim 1, wherein said image on the plate cylinder is built in the form of pyramids.

16. The method of claim 1, wherein the top surface of said image on the plate cylinder comprises an extra tough material.

17. The method of claim 1, wherein said step of depositing and said step of inkjet imaging comprise using liquids based on one of urethane acrylate and methacrylate oligomers.

18. Apparatus for digitally building up flexographic plates, comprising:

a plate substrate for receiving a matrix floor;

curing means for curing said matrix floor;

an imaging surface adjacent said plate substrate;

inkjet imaging means adjacent said imaging surface for ink-jetting an image onto said imaging surface according to pre-stored data;

UV exposing means for gelling said image;

transferring means for transferring said gelled image to said matrix floor; and bonding means for bonding said gelled image with said matrix floor, said gelled image being adapted to receive ink for printing on a print medium.

19. The apparatus of claim 18, wherein said plate substrate forms a sleeve around a plate cylinder of a flexographic printing press.

20. The apparatus of claim 18, wherein said plate substrate comprises a plate cylinder of a flexographic printing press.

21. The apparatus of claim 18, wherein said plate substrate comprises a metal plate.

22. The apparatus of claim 18, wherein said substrate comprises polyester.

23. The apparatus of claim 18, wherein said matrix floor comprises UV curable material.

24. The apparatus of claim 18, wherein said matrix floor comprises a solvent.

25. The apparatus of claim 24, additionally comprising heating means for evaporating said solvent from said matrix floor.

26. The apparatus of claim 19, wherein said curing means is external to said plate cylinder.

27. The apparatus of claim 18, wherein said imaging surface comprises one of a cylinder, a blanket and a belt.

28. The apparatus of claim 18, wherein said UV exposing means is external to said imaging surface.

29. The apparatus of claim 18, additionally comprising means for enlarging the distance between said plate substrate and said imaging surface to allow use of said apparatus with layers of various thickness.

30. The apparatus of claim 18, wherein said matrix floor material and said inkjet ink comprise liquids based on one of urethane acrylate and methacrylate oligomers.

31. A method of printing using a flexographic printing press, comprising the steps of:

a. providing a plate substrate and an imaging surface;

b. depositing an elastomeric matrix floor onto said plate substrate;

c. curing said deposited matrix floor;

d. inkjet imaging one layer on said imaging surface according to pre-stored digital image data;

e. UV exposing said imaged layer to create a gelled layer;

f. transferring said gelled layer from the imaging surface to the surface of the matrix floor on said plate substrate;

g. bonding said gelled layer with the matrix floor;

h. optionally repeating steps (d) through (g) until an image of sufficient thickness is created on said plate substrate; and i. using said imaged plate for printing on said flexographic printing press.

32. The method of claim 31, wherein said step of using comprises transferring said imaged plate to said flexographic printing press.

* * * * *